US007475517B2

(12) United States Patent
Kawai et al.

(10) Patent No.: US 7,475,517 B2
(45) Date of Patent: Jan. 13, 2009

(54) JOINING STRUCTURE OF ROOF TRUSS USING THIN LIGHT-GAUGE SHAPED STEEL

(75) Inventors: Yoshimichi Kawai, Tokyo (JP); Jun Shimizu, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 623 days.

(21) Appl. No.: 10/480,425

(22) PCT Filed: May 20, 2002

(86) PCT No.: PCT/JP02/04856

§ 371 (c)(1),
(2), (4) Date: Dec. 10, 2003

(87) PCT Pub. No.: WO02/101169

PCT Pub. Date: Dec. 19, 2002

(65) Prior Publication Data

US 2004/0154257 A1 Aug. 12, 2004

(30) Foreign Application Priority Data

Jun. 11, 2001 (JP) ..... 2001-176079

(51) Int. Cl.
*E04B 1/38* (2006.01)
*E04C 5/00* (2006.01)

(52) U.S. Cl. ..... 52/702; 52/262; 52/633; 52/92.2; 52/655.1; 52/713; 52/90.1; 52/653.1; 52/639; 52/646; 52/647; 52/648.1; 52/712

(58) Field of Classification Search ..... 52/272, 52/262, 264, 698, 731.7, 733.2, 167.1, 633, 52/92.2, 655.1, 713, 90.1, 702, 289, 709, 52/653.1, 639, 646, 647, 648.1, 712; 403/233, 403/234, 237

See application file for complete search history.

(56) References Cited

U.S. PATENT DOCUMENTS 1,657,243 A * 1/1928 Daniels ..... 403/190

(Continued)

FOREIGN PATENT DOCUMENTS

JP 8-144419 A 6/1996

(Continued)

*Primary Examiner*—Richard E Chilcot, Jr.
*Assistant Examiner*—Chi Q Nguyen
(74) *Attorney, Agent, or Firm*—Kenyon & Kenyon LLP

(57) ABSTRACT

The present invention provides a joining structure of a roof truss using thin light-gauge shaped steel. In a joining structure for joining a subsidiary roof with a main roof, a valley bracket formed by bending a thin steel sheet is inserted and disposed in the longitudinal valley direction of a joining member for joining a rafter forming the subsidiary roof with a truss or a rafter forming the main roof. In a joining structure in which a roof truss upper chord member or a rafter intersects a wall on the upper surface of the wall, a bracket formed by bending a thin steel sheet is disposed at the intersection of these members and fixes the roof truss upper chord member or the rafter to the wall. In a joining structure for the connecting top of the roof truss upper chord member or the rafter, a thin steel sheet member is disposed at the connecting top to fix an end of the roof truss upper chord member or the rafter with an end of a strut, and a box-shaped bracket formed by bending a thin steel sheet to have box-like receiving sections is provided at a top of the thin steel sheet member, for fixing top cleat members.

3 Claims, 7 Drawing Sheets

U.S. PATENT DOCUMENTS

| | | | | | |
|---|---|---|---|---|---|
| 2,611,160 | A | * | 9/1952 | Hanesse | 403/237 |
| 3,333,875 | A | * | 8/1967 | Tracy | 403/170 |
| 3,414,300 | A | * | 12/1968 | Spane | 403/300 |
| 3,423,898 | A | * | 1/1969 | Coloney et al. | 52/713 |
| 4,275,534 | A | * | 6/1981 | Porter | 52/82 |
| 4,335,555 | A | * | 6/1982 | Southerland et al. | 52/639 |
| 4,697,393 | A | * | 10/1987 | Madray | 52/93.2 |
| 4,869,040 | A | * | 9/1989 | Howell | 52/633 |
| 5,715,642 | A | * | 2/1998 | Buers | 52/633 |
| 5,890,339 | A | * | 4/1999 | Willis | 52/640 |
| 5,966,890 | A | * | 10/1999 | Inman | 52/653.2 |
| 5,983,577 | A | * | 11/1999 | Hays | 52/79.1 |
| 6,990,782 | B2 | * | 1/2006 | Shimizu et al. | 52/633 |
| 7,127,862 | B2 | * | 10/2006 | Saldana | 52/715 |

FOREIGN PATENT DOCUMENTS

| | | | |
|---|---|---|---|
| JP | 8-170372 | A | 7/1996 |
| JP | 9-279747 | A | 10/1997 |
| JP | 2564348 | Y2 | 11/1997 |
| JP | 11-350649 | A | 12/1999 |
| JP | 3139787 | B | 12/2000 |
| JP | 2001-49786 | A | 2/2001 |

* cited by examiner

JOINING STRUCTURE OF ROOF TRUSS USING THIN LIGHT-GAUGE SHAPED STEEL

TECHNICAL FIELD

The present invention relates to a joining structure for a building (a roof truss) using thin light-gauge shaped steel, particularly to a structure for joining a subsidiary roof with a main roof in a steel house, a structure for joining a roof truss upper chord member or a rafter used in a roof with walls, and a joining structure for a truss upper chord member or a rafter in a roof top. In this regard, the thin light-gauge shaped steel referred to in the present invention includes various members formed by processing thin steel sheet having a thickness of less than 2.3 mm for the purpose of being used for a building construction.

BACKGROUND ART

There have been low-rise buildings, for example, steel houses, in which various members of thin light-gauge shaped steel formed by roll-forming thin steel sheet having a thickness of less than 2.3 mm are used as structural frames, floor joists or roof members and joined with fasteners.

In the conventional steel house, when a subsidiary roof 2 is attached to a main roof 1 for the purpose of providing a main entrance as shown in FIG. 1(*a*), the main roof 1 is constructed by extending truss upper chord members or rafters 5 from a ridge 3, while the subsidiary roof 2 is constructed by extending rafters 6 from a ridge 4 to the intersection; i.e., a valley line 7; between the main roof and the subsidiary roof. Further, as the joining portion of the truss upper chord member or the rafter 5 with the valley line 7 is oblique to the latter, as shown in FIG. 1(*b*), it is impossible to directly join them with each other. To solve such a problem, a channel bracket 8 is disposed between the rafter 6 and the upper chord or the rafter 5 to cover the truss upper chord or the rafter 5 and fixed thereto by bolts or screws, and a plate bracket 9 is fixed to a tip end of the rafter 6 by bolts or screws, as shown in FIG. 1(*c*).

As described above, the prior art is problematic in that the number of parts increases, the site work requires a great effort since the truss upper chord member or the rafter 5 and the rafter 6 are joined together at many points, and it is difficult to neatly represent the valley line and join the subsidiary roof building with a high accuracy.

As shown in FIG. 3, to join the roof truss upper chord members or the rafters with a wall, a reinforcement member 22 is bridged as a cleat member between the truss upper chord members or the rafters 20-1, 20-2 on the upper surface of the wall 21 in a region in which the roof truss upper chord members or the rafters 20-1, 20-2 intersect the wall 21, so that the opposite ends of the cleat member are fixed to flange portions of the truss upper chord members or the rafters 20-1, 20-2 by means of cleat brackets 23, 23. Also, a saddle bracket 24 may be attached to the intersection between a side surface of the roof truss upper chord member and a surface of the wall 21 to fix the both with each other. According to these construction methods, however, there is a problem in that not only the number of parts or brackets and the material cost to make them increase, but also the working time necessary for attaching them at the construction site becomes enormous.

In addition, as shown in FIGS. 6(*a*) and 6(*b*), two roof truss upper chord members or rafters are joined together at tops thereof via top cleat members even though the roof truss upper chord members or rafters are adjacent to each other. During this joining, many parts such as top bracing members, brackets, lip channels, angles or others must be accurately coupled and joined, which is problematic because the number of parts is excessively large as well as considerable effort is necessary for the assembly thereof.

The present invention has been made to solve the above-mentioned problems by providing a structure for joining a subsidiary roof with a main roof, particularly to a structure for joining a truss upper chord member or a rafter of a main roof with a rafter of a subsidiary roof, wherein a metal hanger formed by bending a thin steel sheet is disposed on a valley line. Also, the present invention provides a structure for joining a roof truss upper chord member or a rafter with a wall, wherein a joining portion in which a cleat member or a saddle bracket is necessary in the prior art is fixed by a metal fixer formed by bending a thin steel sheet. Further, the present invention provides a structure for joining roof truss upper chord members or rafters adjacent to each other, wherein a thin steel sheet member and a box-shaped bracket formed by bending a thin steel sheet are fixed to the join between the roof truss upper chord members or the rafters to join a top cleat member.

DISCLOSURE OF THE INVENTION

The present invention has been made to solve the above problems, and the gist thereof is as follows:

1. A joining structure of a roof truss using thin light-gauge shaped steel for joining a subsidiary roof with a main roof, wherein a valley bracket formed by bending at least one thin steel sheet is disposed at a position inside a valley line defined by a boundary between a rafter forming the subsidiary roof and a truss upper chord member or a rafter forming the main roof to be joined together in the longitudinal direction of the valley line.

2. A joining structure of a roof truss using thin light-gauge shaped steel for joining a subsidiary roof with a main roof, wherein a valley bracket formed by bending at least one thin steel sheet is disposed at a position inside a valley line defined by a boundary between a rafter forming the subsidiary roof and a truss upper chord member or a rafter forming the main roof to be joined together in the longitudinal direction of the valley line; the valley bracket being a gabled structural member comprising extended surfaces at opposite ends thereof capable of being fixed to the truss upper chord member or the rafter with bolts or screws, a central surface having a width corresponding to that of the rafter, an inclined surface having the same inclination angle as the rafter, and a surface extending upward from the truss upper chord member to have a length intersecting the inclined surface.

3. A joining structure of a roof truss using thin light-gauge shaped steel for joining a roof truss upper chord member or a rafter with a wall, wherein an integral bracket formed by bending at least one thin steel sheet is disposed at the intersection of these members so that three sides of the bracket are in contact with a web of the roof truss upper chord member or the rafter and with the upper and side surfaces of the wall, respectively, and fixed thereto by fastening means.

4. A joining structure of a roof truss using thin light-gauge shaped steel, wherein an integral box-shaped bracket formed by bending at least one thin steel sheet to have a connecting section at a top and small receiving sections on left and right sides, respectively, is disposed at a connecting top of roof truss upper chord members or rafters, and wherein top cleat members are fitted into the left and right boxes and the roof truss upper chord members or the rafters, the bracket and the top cleat members are fixed together by fastening means.

5. A joining structure of a roof truss using thin light-gauge shaped steel for joining a subsidiary roof with a main roof, wherein a valley bracket formed by bending at least one thin steel sheet is disposed at a position inside a valley line defined by a boundary between a rafter forming the subsidiary roof and a truss upper chord member or a rafter forming the main roof to be joined together in the longitudinal direction of the valley line; the valley bracket being a gabled structural member comprising extended sections at opposite ends thereof capable of being fixed to the truss upper chord member or the rafter with bolts or screws, a central section disposed adjacent to one end of one extended section at one end thereof and having a width corresponding to that of the rafter, an inclined section disposed adjacent to the other end of the central section at one end thereof and having the same inclination angle as the rafter, and a connecting section having a width defined by one end thereof disposed adjacent to the other end of the inclined section and the other end thereof disposed adjacent to the one end of the other extended section.

6. A joining structure of a roof truss using thin light-gauge shaped steel for joining a roof truss upper chord member or a rafter with a wall, wherein a bracket formed by bending at least one thin steel sheet is disposed at the intersection between these members and fixed to them with fastening means; the bracket comprising a web-contacting section to be brought into contact with a web surface of the roof truss upper chord member or the rafter, an extended section bending from the web-contacting section at a right angle and extending parallel to the upper surface of the wall while being brought into contact therewith, and a side wall surface-contacting section bending from the web-contacting section at a right angle and extending parallel to the side surface of the wall while being brought into contact therewith.

7. A joining structure of a roof truss using thin light-gauge shaped steel in which a roof truss upper chord member or a rafter and a lower chord member intersect each other on the upper surface of a wall within a web surface, wherein the upper chord member or the rafter and the lower chord member are made to intersect and fixed to each other on the upper surface of the wall, and a bracket formed by bending at least one thin steel sheet is disposed at the intersection of these members and fixed to them with fastening means; the bracket comprising a flange-bending section brought into contact with the upper surface of a flange of the lower chord member, a flange-fixing section bending from the flange-bending section at a right angle and extending while being in contact with a surface opposite to the web of the lower chord member to have a length reaching the upper surface of the wall, an extended section bending from the flange-fixing section at a right angle and extending in parallel to the upper surface of the wall while being brought into contact therewith, and a side wall surface-contacting surface bending from the flange-bending section to a position parallel to the side surface of the wall and extending parallel to the side surface of the wall while being in contact therewith.

8. A joining structure of a roof truss using thin light-gauge shaped steel wherein a roof truss upper chord member or a rafter and a lower chord member intersect each other on the upper surface of a wall within the same surface, wherein a tip end of the lower chord member intersects the upper chord member or the rafter on the upper surface of a wall while entering the underside thereof, and the lower chord member and the upper chord member or the rafter are fixed together, and wherein a bracket is formed by bending at least one thin steel sheet is disposed at the intersection of these members and fixed to them by fastening means; the bracket comprising an open section provided with an opening at a top thereof having a width corresponding to that of a flange of the upper chord member or the rafter and a height defined so that the upper end thereof is not projected from the upper surface of the upper chord member, a pair of web-contacting section bending from both sides of the open section at a right angle to be in contact with a web surface of the upper chord member or the rafter and a surface opposite to the web surface, respectively, and a side wall surface-contacting section extending from the open section parallel to a side surface of the wall.

9. A joining structure of a roof truss using thin light-gauge shaped steel wherein a thin steel sheet member is disposed at a connecting top between a roof truss upper chord member or a rafter and a strut and fixed to ends of the roof truss upper chord member or the rafter and the strut, respectively, by fastening means, and a box-shaped bracket is disposed at a top of the thin steel sheet member, which bracket is formed by bending at least one thin steel sheet to have a connecting section at a top thereof and a pair of box sections on the left and right sides thereof, and wherein top cleat members are fitted into the box sections of the bracket, respectively, and the roof truss upper chord member or the rafter, the bracket and the top cleat members are fixed together by fastening means.

10. A joining structure of a roof truss using thin light-gauge shaped steel wherein a thin steel sheet member is disposed at a connecting top between a roof truss upper chord member or a rafter and a strut and fixed to ends of the roof truss upper chord member or the rafter and the strut, respectively, by fastening means, and a bracket is disposed at a top of the thin steel sheet member, which bracket is formed by bending at least one thin steel sheet to have a bending section having a flat portion at a top thereof, a flat surface section disposed adjacent to the bending section, and a pair of left and right box sections formed by bending a bottom portion and two lateral portions adjacent to three sides of the flat surface section to be of a box shape, and wherein top cleat members are fitted into the box sections of the bracket, respectively, and the roof truss upper chord member or the rafter, the bracket and the top cleat members are fixed together by fastening means.

BRIEF DESCRIPTION OF THE DRAWINGS

FIG. 1(*b*) illustrates a conventional connection at a joining position of a truss upper chord member or a rafter in the valley portion shown in FIG. 1(*a*);

FIG. 1(*c*) illustrates a conventional joining structure of the truss upper chord member or the rafter in the valley portion shown in FIG. 1(*a*);

FIG. 2(*b*) illustrates an example in which plywood is attached to the joining structure shown in FIG. 2(*a*);

FIG. 5(*b*) illustrates a joining structure when a roof truss upper chord member or a rafter and a lower chord member intersect on the same surface;

FIG. 5(*c*) illustrates a bracket used in FIG. 5(*b*);

FIG. 6(*b*) schematically illustrates another conventional assembly at a top of a roof truss upper chord member or a rafter and brackets used therefor.

BEST MODE FOR CARRYING OUT THE INVENTION

The present invention will be described below based on the preferred embodiments and with reference to the attached drawings.

Figure 1A:
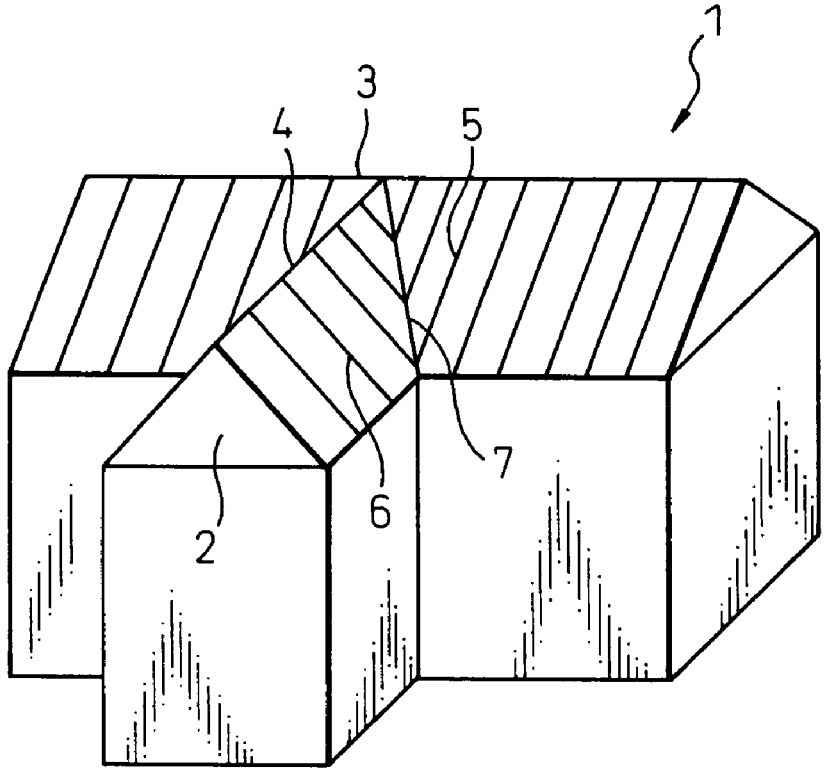
FIG. 1(*a*) illustrates a schematic structure for joining an subsidiary roof with a main roof.
Figure 1B:
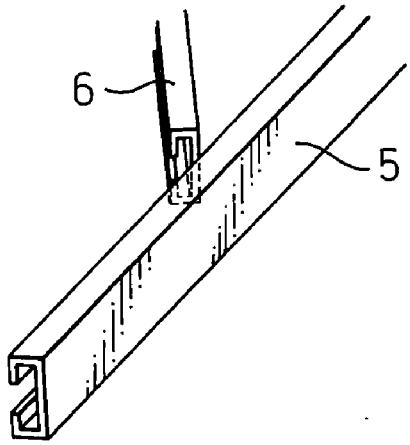
Figure 1C:
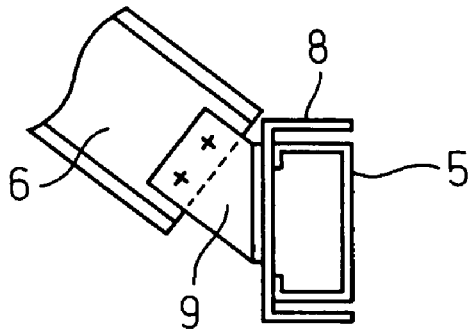
Figure 2A:
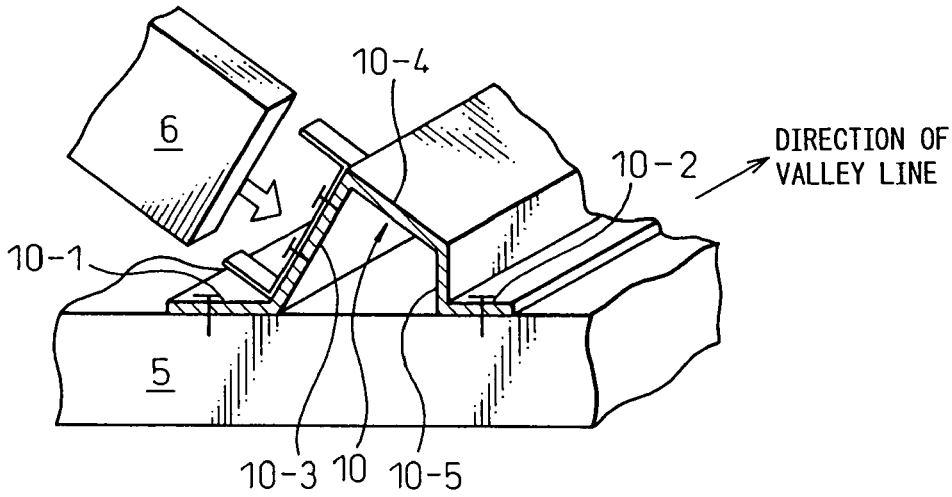
FIG. 2(*a*) illustrates the inventive joining structure of the truss upper chord member or the rafter in the valley portion between the subsidiary roof and the main roof.
Figure 2B:
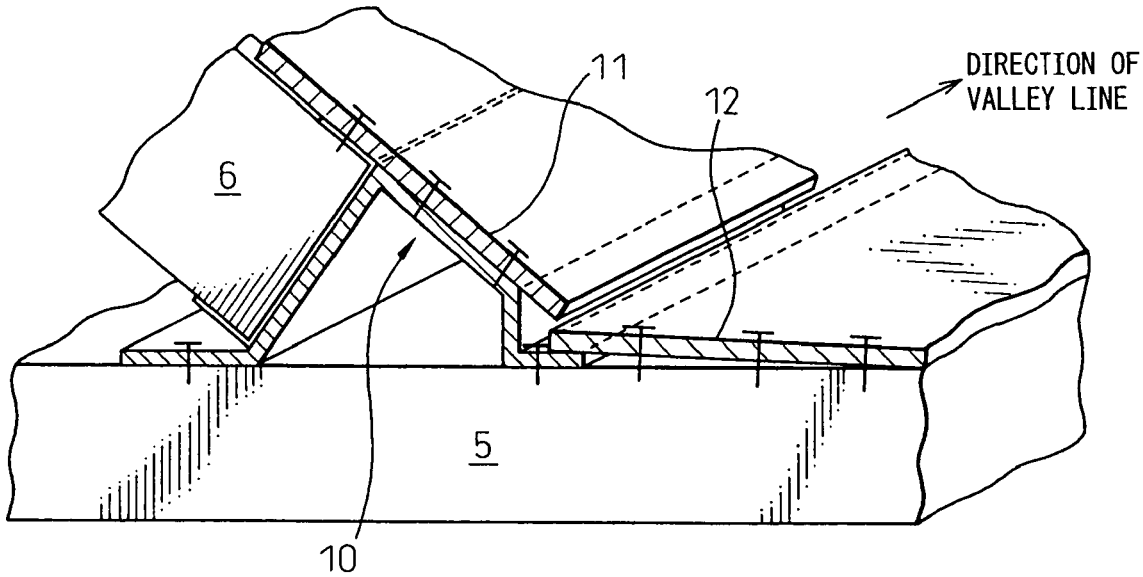

As shown in FIGS. 2(*a*) and 2(*b*), the present invention provides a novel joining structure of a subsidiary roof with a main roof which uses new joining members quite different from the conventional joining structure, and is capable of simplifying the site work and extremely shortening the construction period. In addition, the joining member used in the present invention is a gabled valley bracket 10 formed by bending at least one, preferably one thin steel sheet to coincide with the joined shape of a rafter and a truss upper chord member or another rafter. This valley bracket 10 is disposed at a position inside and in the direction of a valley line 7 in the joining portion between the rafter 6 forming the subsidiary roof and the truss upper chord member or the rafter 5 forming the main roof. The valley bracket 10 is formed by bending a single thin steel sheet to have opposite extended sections 10-1 and 10-2 to be fixed to the upper surface of the truss upper chord member or the rafter 5 with bolts or screws, a central section 10-3 having a width corresponding to that of the rafter 6, an inclined section 10-4 having the same inclination angle as that of the rafter 6 and a section (a joining section) 10-5 extending upward in the vertical direction from the extended section 10-2 in contact with the truss upper chord member or the rafter 5 to have a length intersecting the inclined section 10-4.

As shown in FIG. 2(*b*), when the valley bracket 10 is practically used in the construction site, this member 10 is located at a position inside the valley line 7 and below the rafter 6 forming the subsidiary roof, after which the opposite extended sections 10-1 and 10-2 are fixed to the upper surface of the truss upper chord member or the rafter 5 with bolts or screws, and an end of the rafter 6 is brought into contact with the central section 10-3 having the width corresponding to that of the rafter 6 and fixed thereto with bolts or screws. Thus, the joining structure is completed. By employing such a structure, it is possible to form the joining structure between the subsidiary roof and the main roof in a simple way only by placing a plywood plate 11 on the rafter 6 and the inclined section 10-4 of the valley bracket 10 and fixing the same with bolts or screws, and by placing a plywood plate 12 on the truss upper chord member or the rafter 5 and the extended section 10-2 of the valley bracket 10 and fixing the same with bolts or screws.

As described above, according to the joining structure using the inventive valley bracket, the gable shape of the valley bracket is easily designed to coincide with a size of the rafter 6 and the truss upper chord member or the rafter 5 variable in accordance with a scale of the building. In addition, if this valley bracket is prepared beforehand, it is possible to extremely simply attach this member at a high accuracy to the joining portion between the rafter and the upper chord member only by inserting and setting the same during the site operation. Also, it is possible to complete the attachment operation only by carrying the rafter 6 prepared beforehand to have a suitable length to be matched with this valley bracket in the construction site and by placing and fixing the same with bolts or screws. As there is no divided portion in this valley bracket, an integrated construction of the truss upper chord member or the rafter and the valley bracket is obtainable. As described above, the present invention has a great advantage of eliminating, at once, the troublesome attachment operation in the prior art.

Figure 3:
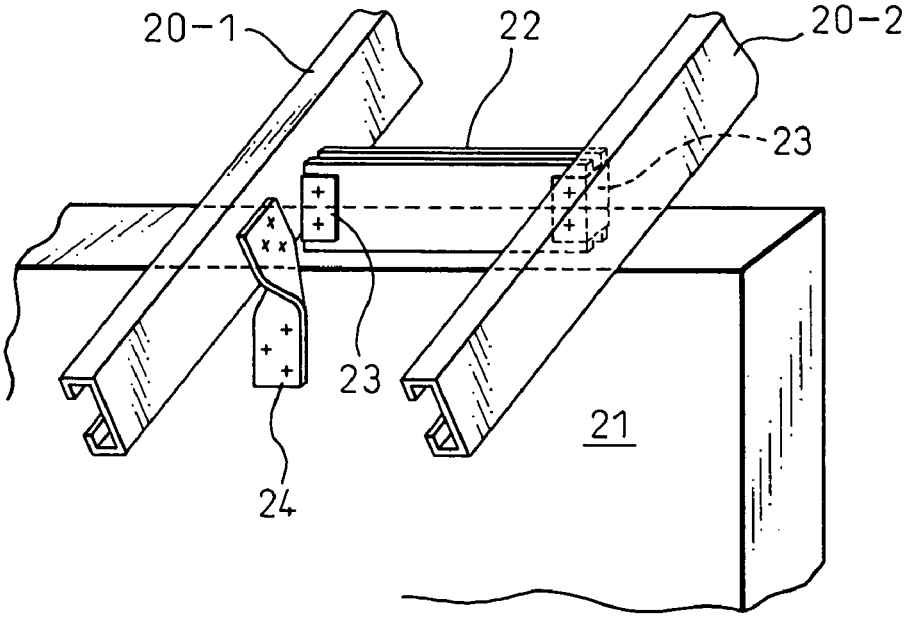
FIG. 3 illustrates a conventional joining structure of a roof truss upper chord member or a rafter with a wall.

In the conventional joining structure between the roof truss upper chord member or the rafter and the wall shown in FIG. 3, the minimum requirement for joining these members is to provide the reinforcement cleat member 22, the cleat bracket 23 and the saddle bracket 24 as described before, which is problematic because an enormous amount of working time is necessary for attaching them. To solve such a problem, according to the present invention, a joining structure shown in FIG. 4 is provided, in which no reinforcement cleat member is necessary, and instead, a bracket 25 formed by bending a single thin steel sheet is used at an intersecting position between a roof truss upper chord member or a rafter 20-1 and a wall 21, for joining and fixing the roof truss upper chord member or the rafter with the wall.

Figure 4:
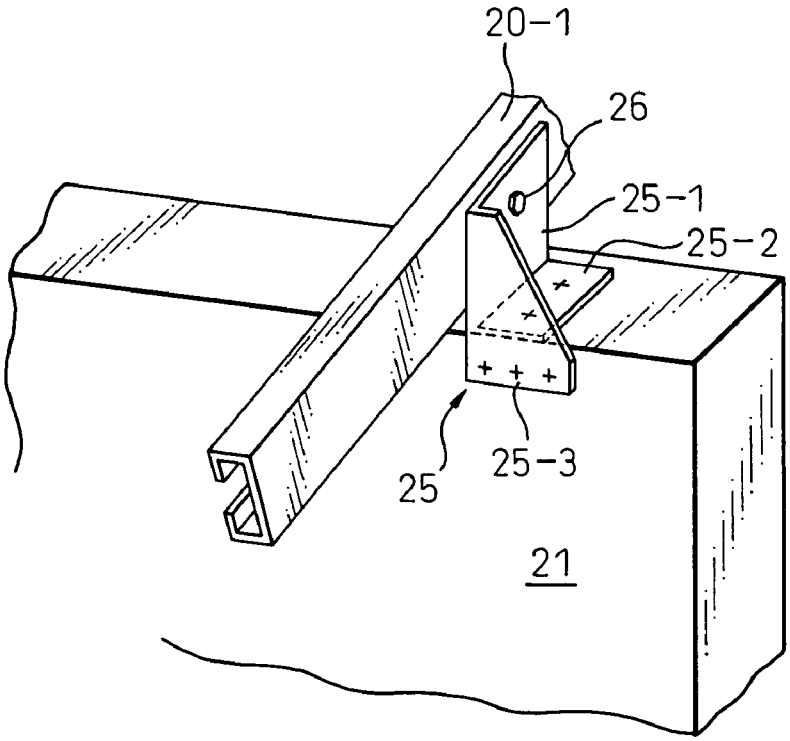
FIG. 4 illustrates the inventive joining structure of a roof truss upper chord member or a rafter with a wall.

As shown in FIG. 4, the structure of this bracket 25 is formed by bending a single thin steel sheet to have a web-contacting section 25-1 in contact with a web surface of the roof truss upper chord member or the rafter 20-1 and fixed to the web surface with fastening means such as a bolt 26, an extended section 25-2 bending from the web-contacting section 25-1 at a right angle and extending parallel to the upper surface of the wall member 21, and a side wall surface-contacting section 25-3 bending from the web-contacting section 25-1 at a right angle to be parallel to a side surface of the wall 21. In this regard, the extended section 25-2 and the side wall surface-contacting section 25-3 are not continuous but separated from each other. The extended section 25-2 and the side wall surface-contacting section 25-3 are fixed to the upper wall surface and the side wall surface, respectively, with screws.

Figure 5A:
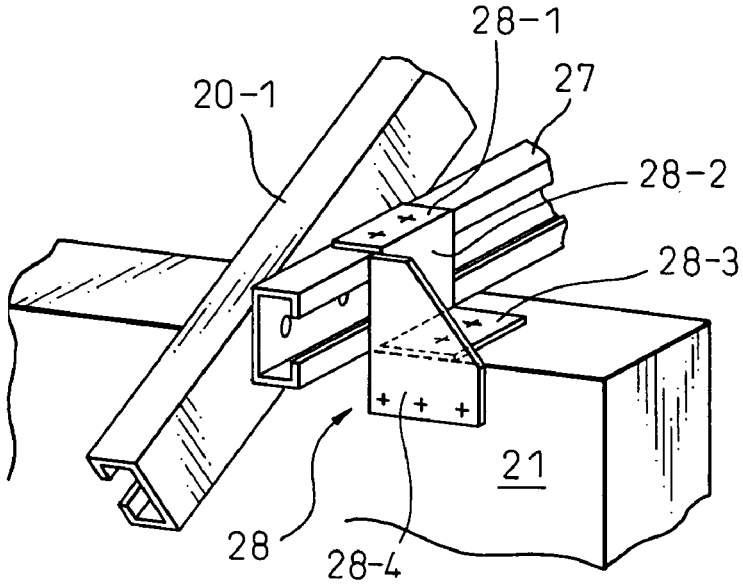
FIG. 5(*a*) illustrates the inventive joining structure of a roof truss upper chord member or a rafter and a lower chord member with a wall when the upper and lower chord members intersect on a web surface.
Figure 5B:
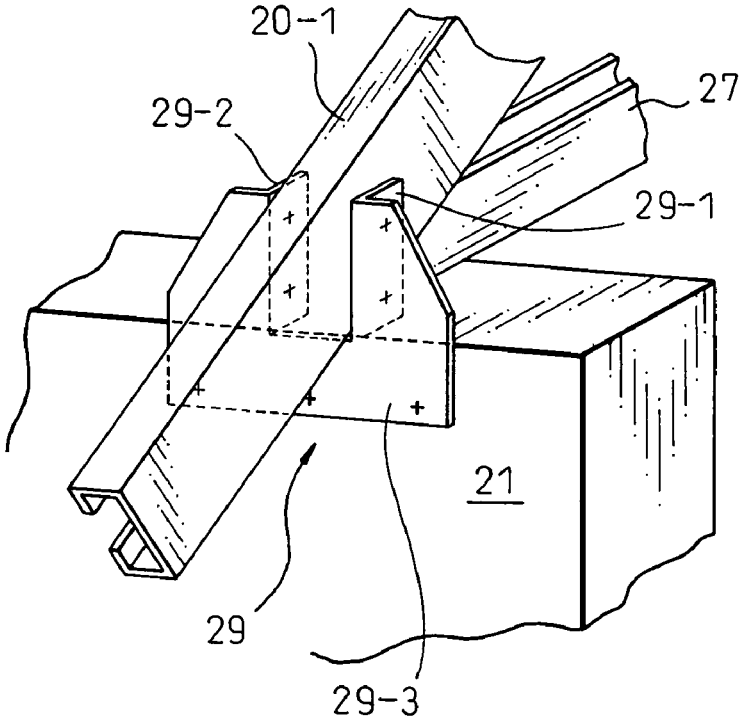
Figure 5C:
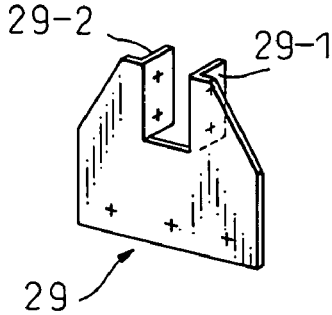

As shown in FIG. 5(*a*), when the roof truss upper chord member or the rafter and the lower chord member, and the wall intersect each other on the web surface of the roof truss upper chord member or the rafter and the lower chord member, the roof truss upper chord member or the rafter 20-1 is connected and fixed to the lower chord member 27 and the wall 21 by using a bracket 28 formed by bending a single thin steel sheet and located at an intersecting position between the lower chord member 27 and the wall 21.

This bracket 28 is structured, as shown in FIG. 5(*a*), by bending a single thin steel sheet to have a flange-bending section 28-1 in contact with a flange surface of the roof truss lower chord member 27 and fixed thereto with screws, a flange-fixing section 28-2 bending from the flange-bending section 28-1 at a right angle and extending to the upper surface of the wall 21 to have a length corresponding to the width of the web, an extended section 28-3 bending from the flange-fixing section 28-2 at a right angle and extending parallel to the upper surface of the wall 21, and a side wall surface-contacting section 28-4 bending from the flange-bending section 28-1 at a right angle to be parallel to the side surface of the wall 21. In this regard, the extended section 28-3 and the side wall surface-contacting section 28-4 are not continuous but separated from each other. The extended section 28-3 and the side wall surface-contacting section 28-4 are fixed to the upper wall surface and the side wall surface, respectively, with screws. In this regard, the flange-bending section 28-1, the flange-fixing section 28-2 and the extended section 28-3 preferably have a width corresponding to a thickness of the wall 21.

As shown in FIGS. 5(*b*) and 5(*c*), according to the present invention, when the roof truss upper chord member or the rafter 20-1 intersects the lower chord member 27 in the same plane on the upper surface of the wall 21; that is, when a tip end portion of the roof truss lower chord member 27 intersects the roof truss upper chord member or the rafter 20-1 while entering under the latter; the roof truss upper chord member or the rafter 20-1 is fixed to the lower chord member 27 by an optional method and, then, the roof truss upper chord member or the rafter 20-1 and the lower chord member 27 are fixed with the wall 21 by using a bracket 29 formed by bending a single thin steel sheet to have an open section of a width corresponding to that of a flange of the roof truss upper chord member or the rafter 20-1 and a height defined so that an upper end of the bracket does not exceeds the upper surface of the flange of the upper chord member or the rafter 20-1, which bracket 29 includes a pair of web-contacting sections 29-1 and 29-2 having a surface in contact with a web surface of the roof truss upper chord member or the rafter 20-1 and a surface opposite to the web surface, respectively, and a side wall surface-contacting section 29-3 extending therefrom parallel to the wall 21.

Figure 6A:
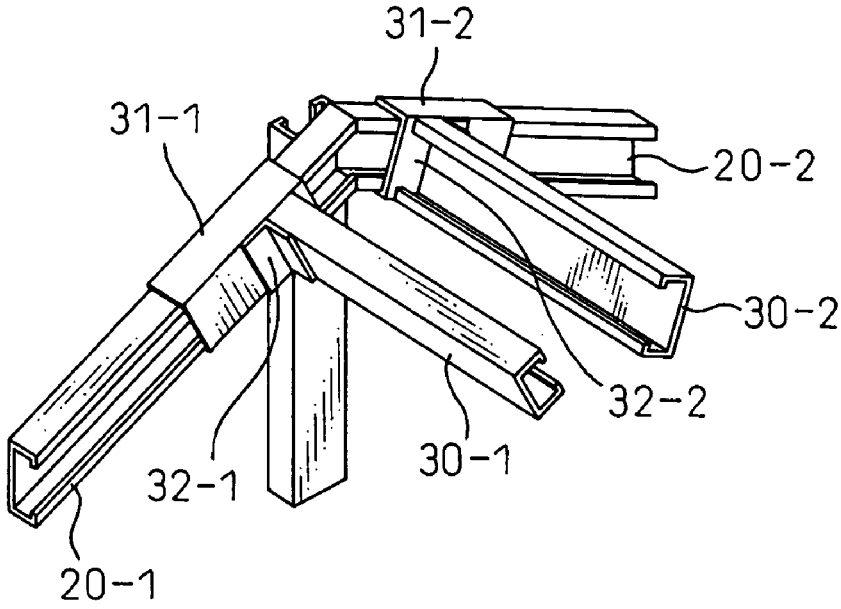
FIG. 6(*a*) schematically illustrates a conventional assembly at a top of a roof truss upper chord member or a rafter and brackets used therefor.
Figure 6B:
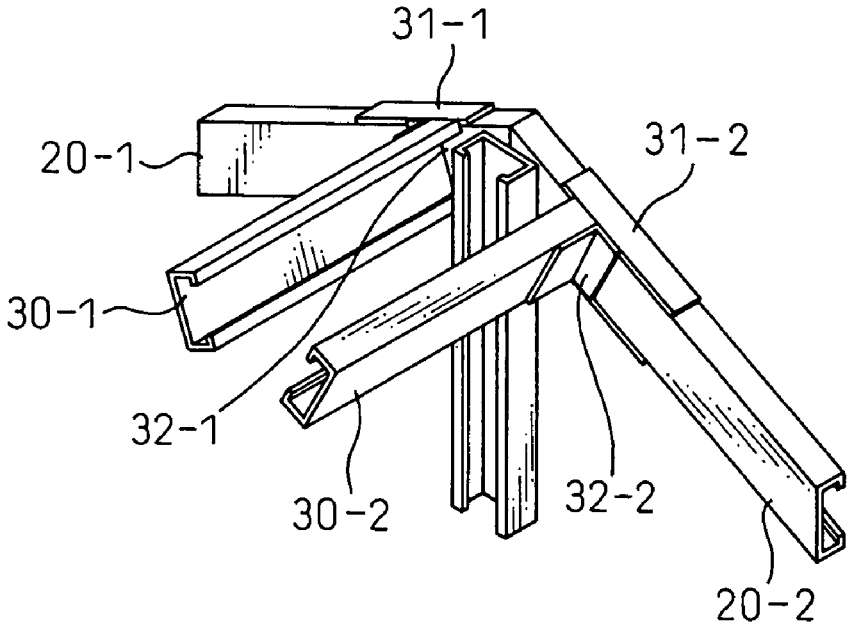

As shown in FIGS. 6(*a*) and 6(*b*), in a join between a pair of roof truss upper chord members or rafters, when coupled either on the web surface of the respective roof truss upper chord members or rafters 20-1 and 20-2 or on a portion (surface) opposite to the web surface, top cleat members 30-1 and 30-2 are abutted to the roof truss upper chord members or the rafters 20-1, 20-2, respectively, at a right angle, and as shown in FIG. 6(*b*), brackets 31-1 and 31-2 are arranged and fixed at these connecting positions, and angle members 32-1, 32-2 or other top pressing members or lip channels not shown are used for fixing the brackets or the web surface of the roof truss upper chord members or the rafters to the top cleat members at a right angle. As described before, however, it is necessary in this method to accurately connect and join many parts together, such as top pressing members, brackets, lip channels or angle steel members. This is problematic in that the number of parts is excessively large and a considerable effort is required for the assembly thereof.

According to the present invention, in view of such a problem, a thin steel sheet member (a gusset plate) is provided at a joining top between the roof truss upper chord members or the rafters 20-1, 20-2 and a strut 35, and ends of the roof truss upper chord members or the rafters 20-1, 20-2 and the strut 35 are joined and fixed to the surface of the thin steel sheet member 36. A box-shaped bracket 33 formed by bending a single thin steel sheet is disposed at the top of the thin steel sheet member (gusset plate) 36 and connected and fixed to a first top cleat member 40 and a second top cleat member (41). The box-shaped bracket 33 is formed by bending a single thin steel sheet as shown in FIG. 7 to be provided with a bending section 34 having a flat portion at a top thereof, a pair of flat surface section 33-1 extending from the bending section 34 leftward and rightward generally at a right angle, and a bottom section 33-2 and lateral sections 33-3, 33-4 bent to form a box shape encircling three sides of the flat surface section while leaving a vacant space in the interior thereof.

Figure 7:
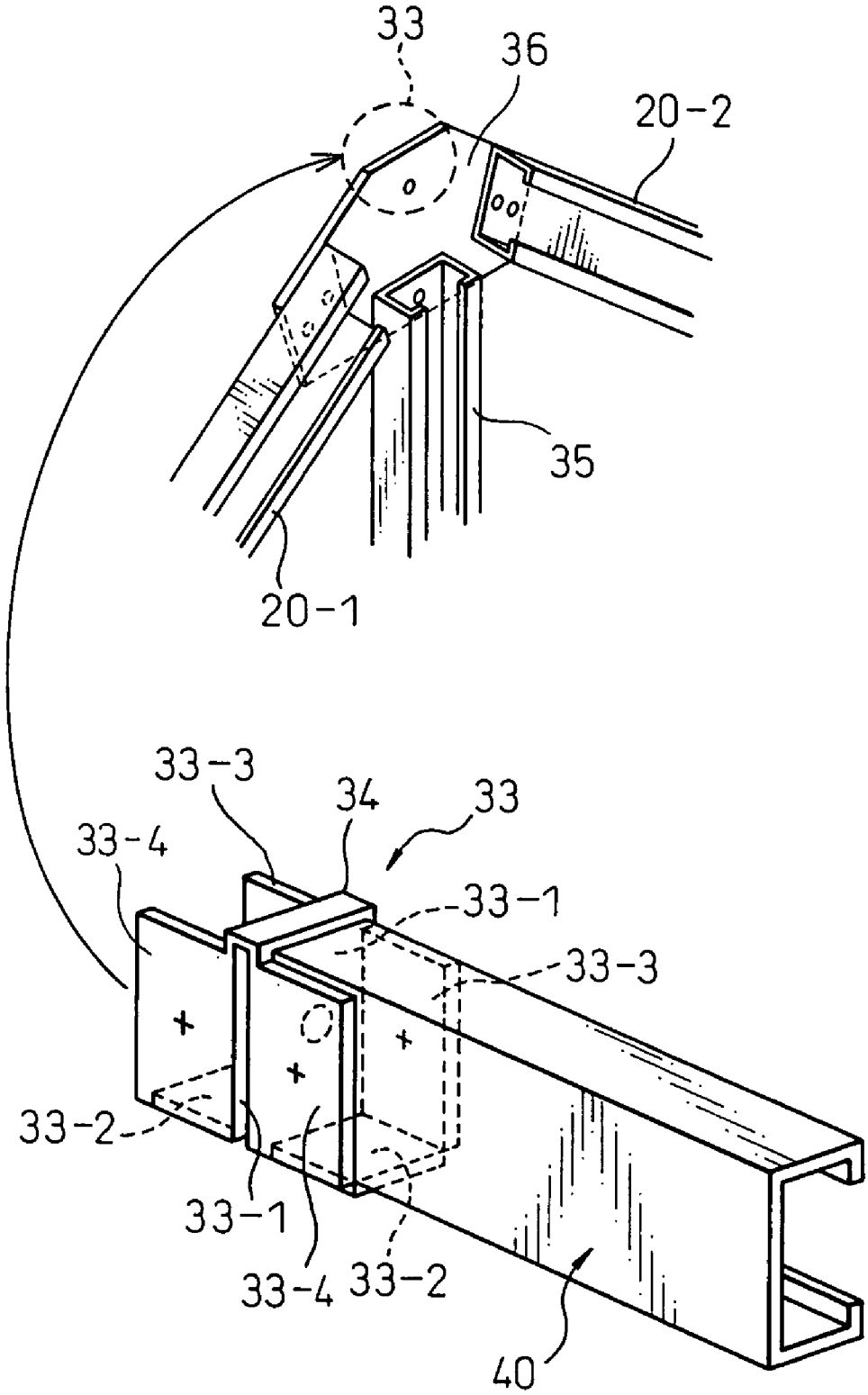
FIG. 7 schematically illustrates the inventive assembly at a top of a roof truss upper chord member or a rafter and brackets used therefor.
Figure 8:
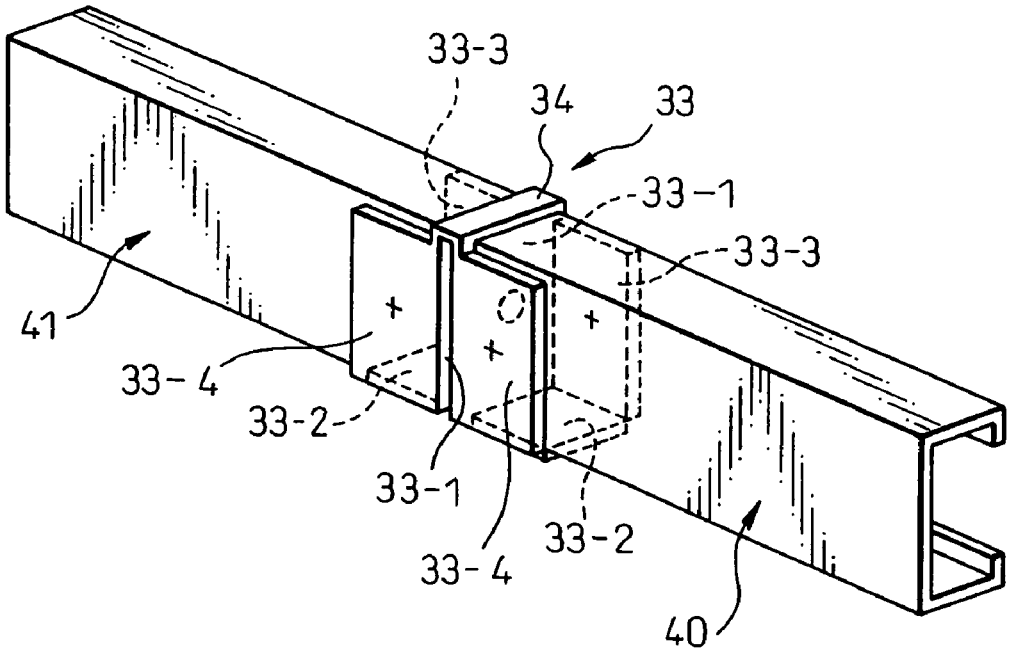
FIG. 8 schematically illustrates a first top cleat member and a second top cleat member fitted into a box-shaped bracket, in accordance with the present invention.

In this regard, while the thin steel sheet member (gusset plate) 36 preferably has a hexagonal shape as shown in FIG. 7, it should be noted that this is not limitative, but may be any shape provided there is an area in the top of the thin steel sheet member, capable of receiving the flat bending section 34 of the bracket, and the joining top has a surface and a shape capable of fixing the ends of the roof truss upper chord members or the rafters 20-1, 20-2 and the strut 35 at the respective positions.

To easily dispose and fix the thin steel plate (gusset plate) 36 at the joining top of the roof truss upper chord members or the rafters 20-1, 20-2 and the strut 35, the surface of the gusset plate 36 is opposed to the web surface or the surface opposite thereto of the roof truss upper chord members or the rafters 20-1, 20-2 and the strut 35, and both the surfaces are fixed with bolts or screws. When the bracket 33 is actually disposed and fixed to the join of the roof truss upper chord members or the rafters 20-1, 20-2, the top cleat members 40 are first inserted into the left and right vacant spaces of the bracket 33 to be brought into contact with the lateral sections 33-3, 33-4 of the bracket 33, and then the bracket 33 is fixed with screws. By employing the bracket of such a simple structure, it is possible to easily connect and join the adjacent roof truss upper chord members or the rafters to each other.

CAPABILITY OF EXPLOITATION IN INDUSTRY

As described hereinbefore, according to the present invention, it is possible to extremely easily connect and join the respective members with each other, via a simple joining member (bracket), in a joining structure for a roof truss built by using thin light-gauge shaped steel, particularly a joining structure for a steel house for joining a subsidiary roof with a main roof, a joining structure for joining a roof truss upper chord member or a rafter used for a roof with a wall, and a joining structure for joining a roof truss upper chord members or rafters with each other at a roof top of a truss structure, whereby the number of joining parts is reduced to save effort, in the assembly thereof, to a great extent.

The invention claimed is:

1. A joining structure of a roof truss using thin light-gauge shaped steel comprising:

said roof truss including a first roof truss upper chord member or rafter (20-1) and a second roof truss upper chord member or rafter (20-2);

a connecting top (36) formed by a thin steel sheet member connecting the first roof truss upper chord member or rafter (20-1) and the second roof truss upper chord member or rafter (20-2);

an integral box-shaped bracket (33) formed by bending at least one thin steel sheet, said integral box shaped bracket (33) having a top section (34), a right box section (33-1, 2, 3, 4) located to the right of said top section (34) and a left box section (33-1, 2, 3, 4) located to the left of said top section (34); said right box section having a flat surface section (33-1) downwardly extending from the right side of said top section (34) and said left box section having a flat surface section (33-1) downwardly extending from the left side of said top section (34);

said connecting top (36) having a portion at its top on which said top section (34) of said box-shaped bracket (33) is received;

a first top cleat member (40) fitted into said right box section (33-1, 2, 3, 4) and a second top cleat member (41) fitted into said left box section (33-1, 2, 3, 4);

wherein said box-shaped bracket (33) is fixed to the thin steel sheet member of said connecting top (36) by said thin steel sheet member of said connecting top (36) lying between the flat surface (33-1) of the right box section and the flat surface (33-1) of the left box section and receiving top section (34) of said box shaped bracket (33) and connected by fastening means extending in the direction of said first and second top cleat members (40, 41);

wherein said first top cleat member (40) is fixed to said right box section (33-1, 2, 3, 4) by fastening means and said second top cleat member (41) is fixed to said left box section (33-1, 2, 3, 4) by fastening means.

2. A joining structure of a roof truss using thin light-gauge shaped steel comprising:

said roof truss including a first roof truss upper chord member or rafter (20-1) and a second roof truss upper chord member or rafter (20-2);

a connecting top (36) formed by a thin steel sheet member connecting the first roof truss upper chord member or rafter (20-1) and the second roof truss upper chord member or rafter (20-2), with the first roof truss upper chord member or rafter (20-1) and the second roof truss upper chord member or rafter (20-1) joined to the connecting top (36) by fastening means;

a strut (35) joined to said connecting top (36) by fastening means, with said strut (35) downwardly extending from said connecting top (36) and located between the first and second roof truss upper chord members or rafters;

a box-shaped bracket (33) formed by bending at least one thin steel sheet, said box-shaped bracket having a connecting section (34) disposed at a top of said box-shaped bracket (33), a right box section (33-1, 2, 3, 4) located at the right of said connecting section (34) and a left box section (33-1, 2, 3, 4) located at the left of said connecting section (34); said right box section having a flat section (33-1) downwardly extending from the right side of said connecting section (34) and said left box section having a flat section (33-1) downwardly extending from the left side of said connecting section (34);

said connecting top (36) having a portion at its top on which connecting section (34) of said box-shaped bracket (33) is received;

a first top cleat member (40) fitted into said right box section (33-1, 2, 3, 4) and a second top cleat member (41) fitted into said left box section (33-1, 2, 3, 4);

wherein said box-shaped bracket (33) is fixed to the thin steel sheet member of said connecting top (36) by said thin steel sheet member of said connecting top (36) lying between the flat surface (33-1) of the right box section and the flat surface (33-1) of the left box section and receiving connecting section (34) of said box shaped bracket (33) and connected by fastening means extending in the direction of said first and second top cleat members (40, 41);

wherein said first top cleat member (40) is fixed to said right box section (33-1, 2, 3, 4) by fastening means and said second top cleat member (41) is fixed to said left box section (33-1, 2, 3, 4) by fastening means.

3. A joining structure of a roof truss using thin light-gauge shaped steel comprising:

said roof truss including a first roof truss upper chord member or rafter (20-1) and a second roof truss upper chord member or rafter (20-2);

a connecting top (36) formed by a thin steel sheet member connecting the first roof truss upper chord member or rafter (20-1) and the second roof truss upper chord member or rafter (20-2);

a strut (35) joined to said connecting top (36), with said strut (35) downwardly extending from said connecting top (36) and located between the first and second roof truss upper chord members or rafters;

a box-shaped bracket (33) formed by bending at least one thin steel sheet, said box-shaped bracket (33) have a flat top bending section (34) at a top of said box-shaped bracket, a right box section (33-1, 2, 3, 4) located at the right of said flat top bending section (34) and a left box section (33-1, 2, 3, 4) located at the left of said flat top bending section (34);

said right box section comprising a flat surface section (33-1) downwardly extending from the right side of said flat top bending section (34), a lateral section (33-3, 4) extending to the right from each side of said flat surface section (33-1), and a bottom section (33-2) extending to the right from a bottom of said flat surface section (33-1);

said left box section comprising a flat surface (33-1) downwardly extending from the left side of said flat top bending section (34), a lateral section (33-3, 4) extending to the left from each side of said flat surface section (33-1), and a bottom section (33-2) extending to the left from a bottom of said flat surface section (33-1);

said connecting top (36) having a portion at its top on which flat top bending section (34) of said box shaped bracket (33) is received;

a first top cleat member (40) fitted into said right box section (33-1, 2, 3, 4) and a second top cleat member (41) fitted into said left box section (33-1, 2, 3, 4);

wherein said box-shaped bracket (33) is fixed to the thin steel sheet member of said coanecting top (36) by said thin steel sheet member of said connecting top (36) lying between the flat surface (33-1) of the right box section and the flat surface (33-1) of the left box section and receiving flat top bending section (34) of said box shaped bracket (33) and connected by fastening means extending in the direction of said first and second top cleat members (40, 41);

wherein said first top cleat member (40) is fixed to said right box section (33-1, 2, 3, 4) by fastening means and said second top cleat member (41) is fixed to said left box section (33-1, 2, 3, 4) by fastening means.

* * * * *